United States Patent [19]

DeLuca

[11] 4,188,844

[45] Feb. 19, 1980

[54] DISPENSER FOR ROLLS OF FLEXIBLE SHEET MATERIAL AND CUTTER MECHANISM FOR USE THEREIN

[75] Inventor: Raymond F. DeLuca, Stamford, Conn.

[73] Assignee: Georgia-Pacific Corporation, Portland, Oreg.

[21] Appl. No.: 842,533

[22] Filed: Oct. 14, 1977

[51] Int. Cl.[2] ..... B26D 1/56

[52] U.S. Cl. ..... 83/337; 83/335; 83/349

[58] Field of Search ..... 83/337, 335, 349

[56] References Cited

*Primary Examiner*—Donald R. Schran

*Attorney, Agent, or Firm*—Schuyler, Birch, McKie & Beckett

[57] ABSTRACT

A mechanism for cutting a web of flexible sheet material which is adapted to be used in a dispenser having a feed roller and a pinch roller between which rollers the web passes. A knife is pivotally mounted in the feed roller to swing about an axis laterally displaced from the plane of a radially outward portion of the knife defining a cutting edge which edge is projected outwardly beyond the periphery of the feed roller to cut the web as it passes over the feed roller and cam followers are carried by the ends of the knife extending beyond the ends of the feed roller with the followers displaced from the pivot mounting axis of the knife. Stationary cams

DISPENSER FOR ROLLS OF FLEXIBLE SHEET MATERIAL AND CUTTER MECHANISM FOR USE THEREIN

BACKGROUND OF THE INVENTION

This invention relates to dispensers, and specifically to a flexible sheet material dispenser, such as useable for dispensing paper towels, and a mechanism adapted to be used therein for cutting a web of flexible sheet material into individual lengths of the material.

Dispensers for flexible sheet material, such as paper toweling have long been known to include mechanisms for perforating or severing a web of such material to divide the web into individual sheets. Generally the perforating or severing mechanisms used in these dispensers include a rotatably mounted knife and a cooperating rotatably mounted roller having a slot therein for receiving the radially outward portion of the knife as the knife rotates past the roller. The web of flexible sheet material is passed between the roller and the knife to be perforated or severed when the radially outward knife portion enters the slot in the roller.

Such mechanisms are satisfactory for perforating or severing relatively unstretchable flexible sheet materials, such as uncreped paper toweling. However, with the increased use of relatively stretchable flexible sheet materials, such as embossed and creped paper toweling, the prior art perforating and severing mechanisms have proved unsatisfactory because the web of sheet material tends to stretch about the cutting edge of the knife instead of being perforated or severed thereby. Although precession rotary shears are known which could be employed for obviating this problem, such shears are much to expensive to be used in flexible sheet material dispensers designed for installation to be used in both commercial and private washrooms.

SUMMARY OF THE INVENTION

The cutting mechanism of the present invention offers an economical solution to the severing mechanisms used in the prior art flexible sheet material dispensers.

Basically the cutting mechanism of the invention comprises a chassis, means for rotatably supporting a roll of flexible sheet material on the chassis, means for guiding a roll of flexible sheet material from the roll to be grasped by a user, so that the user may pull the web out of the dispenser, and a rotatably mounted feed roller on the chassis over which the web of material passes. A knife is pivotally mounted in the feed roller to swing about an axis which is laterally displaced from the plane of the knife radially outwardly of the portion of the knife defining a cutting edge for the web. This edge is projected outwardly through an apening in the feed roller beyond the periphery of the feed roller to cut the web as it passes over the feed roller. The knife carries cam followers displaced from the plane of the pivot mounting axis of the knife and stationary cams are mounted adjacent the ends of the feed roller with which the cams followers on the knife engage to positively project and retract the knife cutting edge upon rotation of the feed roller.

The dispenser of the invention, in which the above-described cutting mechanism is adapted to be used, preferably is provided with a stop device for stopping the rotation of the knife and the roller, and thus arresting the movement of the web so that when an individual sheet of material is severed from the web along the last severing by the cutting edge, the free end of the material may be immediately accessable to a user.

With the foregoing in mend, it is an object of the present invention to provide a flexible sheet material dispenser having a mechanism for effectively cutting a web of flexible sheet material being removed from a roll within the dispenser.

It is also an object of the invention to provide a mechanism for cutting a web of sheet material which mechanism includes a knife within a feed roller where the knife is projected outwardly beyond the periphery of the feed roller to cut the web as it passes over the feed roller.

A further object of the invention is to provide a flexible sheet material dispenser wherein a cutting knife is pivotally mounted within a feed roller and stationary cams external of the feed roller operates to positively project and retract the cutting knife incident rotation of the feed roller.

It is an additional object of the invention to provide a flexible sheet material dispenser having mechanism for cutting a web of flexible sheet material, which dispenser is compact, rugged and economical to manufacture, that is ideally suited for both commercial and private installations.

These and other objects of the invention will become apparent upon consideration of the detailed description of a preferred embodiment of the invention given in connection with the following drawings.

DESCRIPTION OF THE PREFERRED EMBODIMENTS

Figure 1:
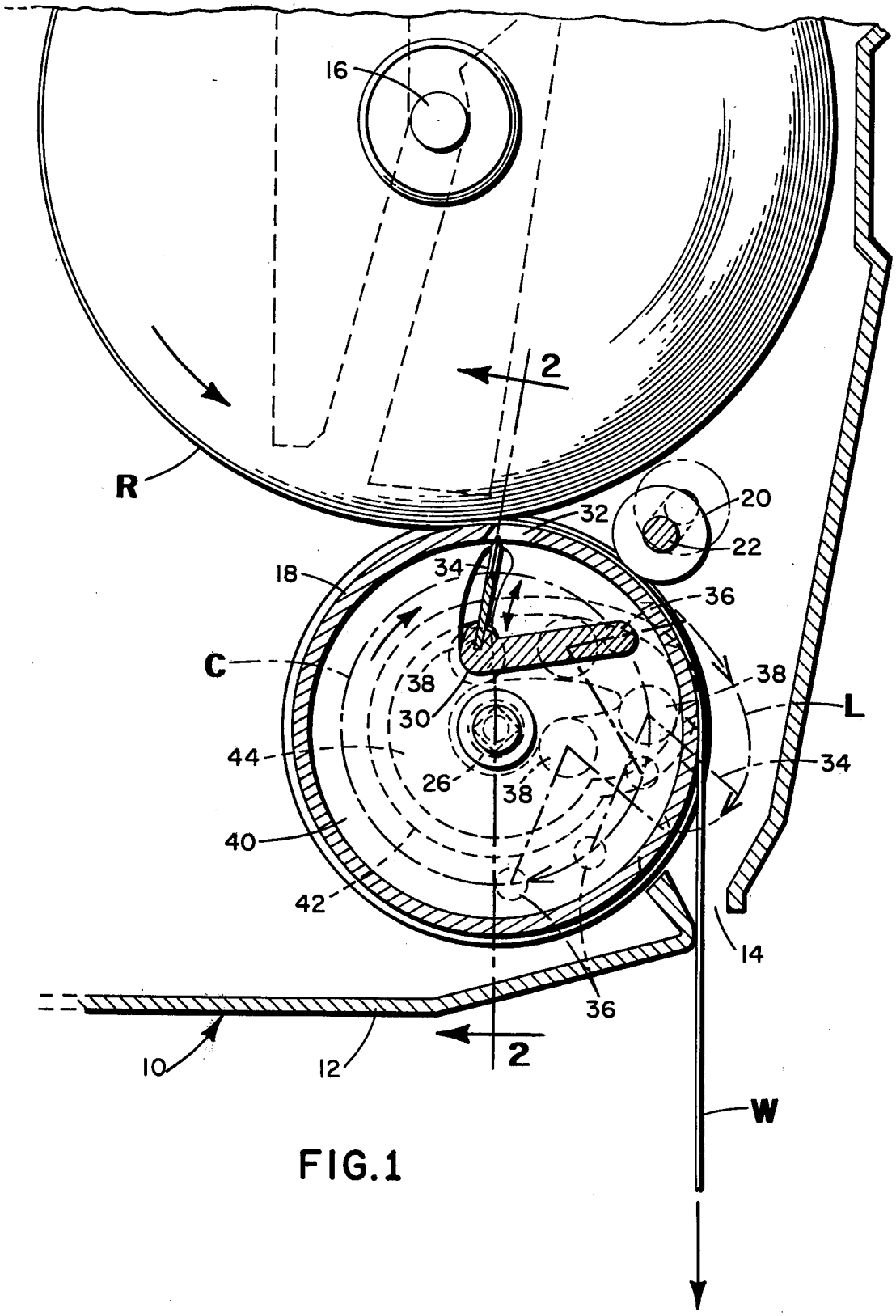
FIG. 1 is a sectional view of the front portion of the dispenser of this invention showing the cutting mechanism within the chassis in relation to a roll of flexible sheet material.

Referring to FIG. 1 the dispenser 10 has a chassis 12, only a part of which is shown in FIG. 1. The chassis has an opening 14 at its lower forward end through which the web W of flexible sheet material, such as paper toweling passes to be available to the user. The web W is taken from a roll R mounted in the dispenser on a suitable supporting shaft 16. The web W as withdrawn from roll R passes over a rotatably mounted feed roller 18 and then down and out through opening 14. A pinch roller 20 mounted on a shaft 22 is spring biased into engagement with the exterior of feed roller 18 with the web W of flexible sheet material passing between the pinch roller and the feed roller.

The feed roller 18 is rotatably mounted within the chassis 12 of the dispenser on stub shafts 24 and 26 with stub shaft 26 carrying at its outer end a feed wheel 28. The feed wheel is secured to rotate with the feed roller and function in a manner to be described in the dispersing and cutting of a length of web W removed from the roll R.

Figure 4:
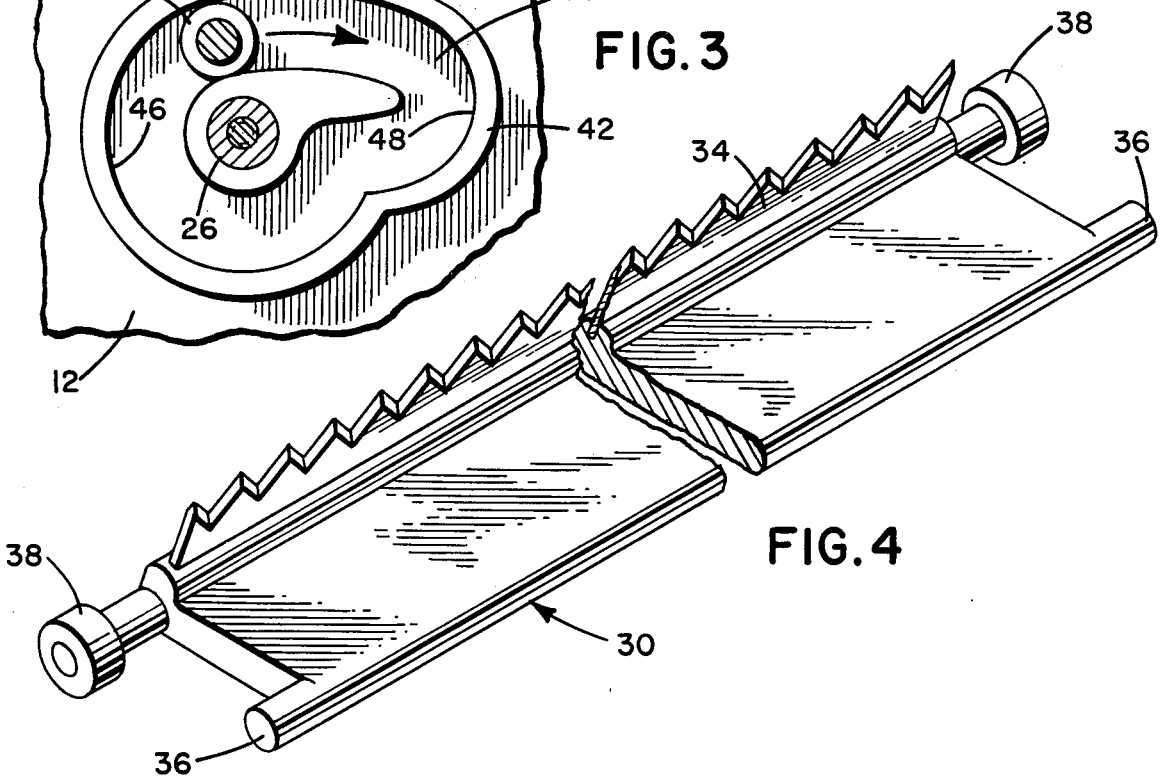
FIG. 4 is a perspective view of the cutting knife that is mounted in the feed roller shown in FIGS. 1 and 2.

The feed roller 18 has pivotally mounted there within a knife 30 the structure of the knife being shown in FIG. 4. The knife is mounted to swing about an axis which is laterally displaced from the plane of the cutting edge 34 of the knife. The feed roller 18 has an opening 32 formed in the periphery of the feed roller so that the cutting edge 34 of the knife can be projected beyond the exterior of the feed roller 18 and retracted back into the feed roller. Broken line L on FIG. 1 shows the path of the projection of this cutting edge 34 beyond the periphery of feed roller 18 as the roller rotates so that the web is effectively severed to enable removal of the flexible sheet material by the user.

Referring to the structure of knife 30 as best seen in FIG. 4, the pivotal mounting is provided by stubs 36 one being disposed on each end of the knife 30 providing a pivot axis which is displaced from the plane of knife cutting edge 34. The knife also has at each end, disposed in the plane of the knife cutting edge, cam followers 38.

The pivot stubs 36 are mounted in the end walls 40 of the feed roller 18 to support the knife 30 so as to be swingable about an axis which is laterally displaced from the plane of the knife cutting edge 34. The control of movement of the knife to project from opening 32 and be retracted back into the feed roller 18 is achieved by the cam followers 38 engaging in stationary plate cams 42, one such cam being mounted within the chassis 12 adjacent each end of feed roller 18.

Figure 2:
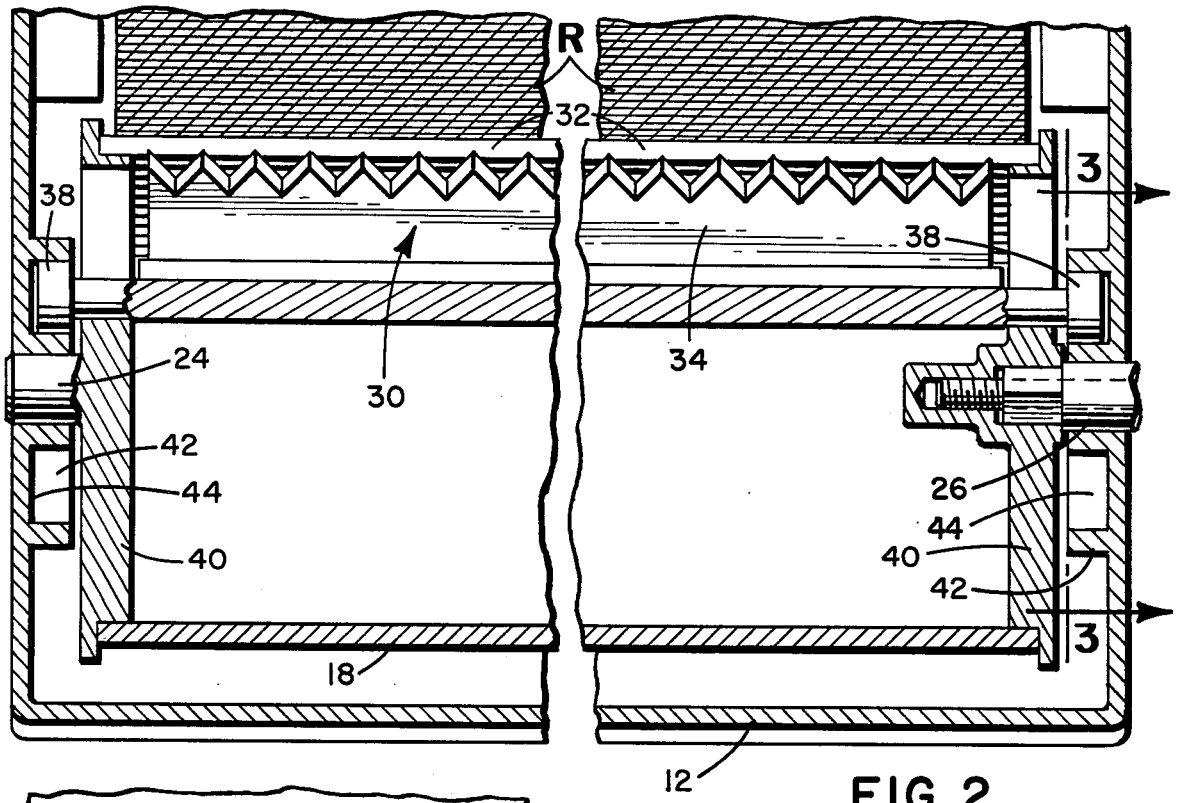
FIG. 2 is a sectional view taken on line 2—2 of FIG. 1.
Figure 3:
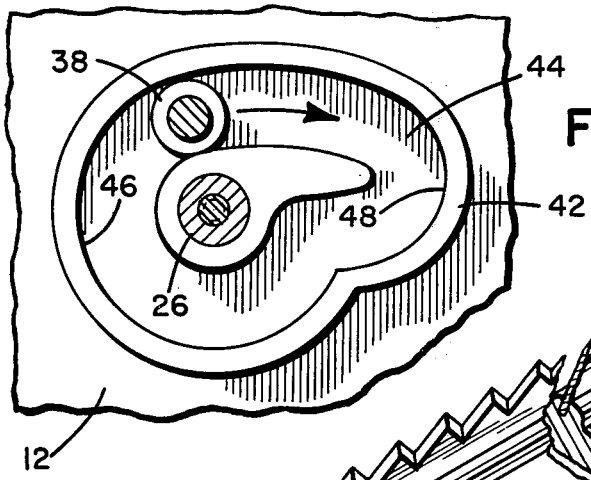
FIG. 3 is an elevational view taken on line 3—3 of FIG. 2.

The configuration of each plate cam 42 is shown in FIG. 3. It has a pocket 44 of substantially uniform width throughout its length to receive one cam follower 38. In each case the pocket 44 opens toward the end of the feed roller 18 as shown in FIG. 2. The Pocket 44 in each plate cam 42 has a parti-cylindrical portion 46 with its center of curvature corresponding with the axis of the feed roller 18 provided by the stub shafts 24 and 26. The pocket 44 also has an outwardly curved portion 48 extending away from the axis of the feed roller 18. This latter portion is joined at its ends with the ends of the parti-cylindrical portion 46 to form pocket 44 into an endless cam configuration to actuate one cam follower 38 upon rotation of feed roller 18.

On FIG. 1 broken line circle C shows the path of movement of the mounting stubs 36 of knife 30 as the feed roller 18 rotates. This figure also illustrates four successive positions for the axis of stubs 36 and movement of cam followers 38 withn the pockets 44 of plate cams 42. As previously mentioned the broken line L on FIG. 1 shows the pattern of movement of the cutting edge 34 of knife 30 caused by the cam followers 38 being guided within the pockets 44 of the plate cams 42. From this path of movement it will be seen that the cutting edge 34 starts to project beyond the periphery of feed roller 18 immediately beyond the point of engagement of pinch roller 20 with feed roller 18.

Figure 5:
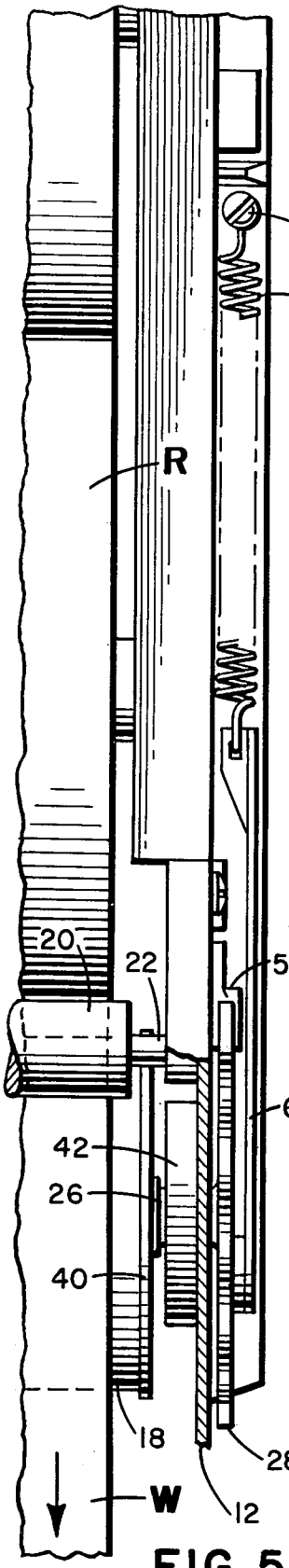
FIG. 5 is a view partly in section showing the over-center means for driving the feed roller through a portion of each rotation.
Figure 6:
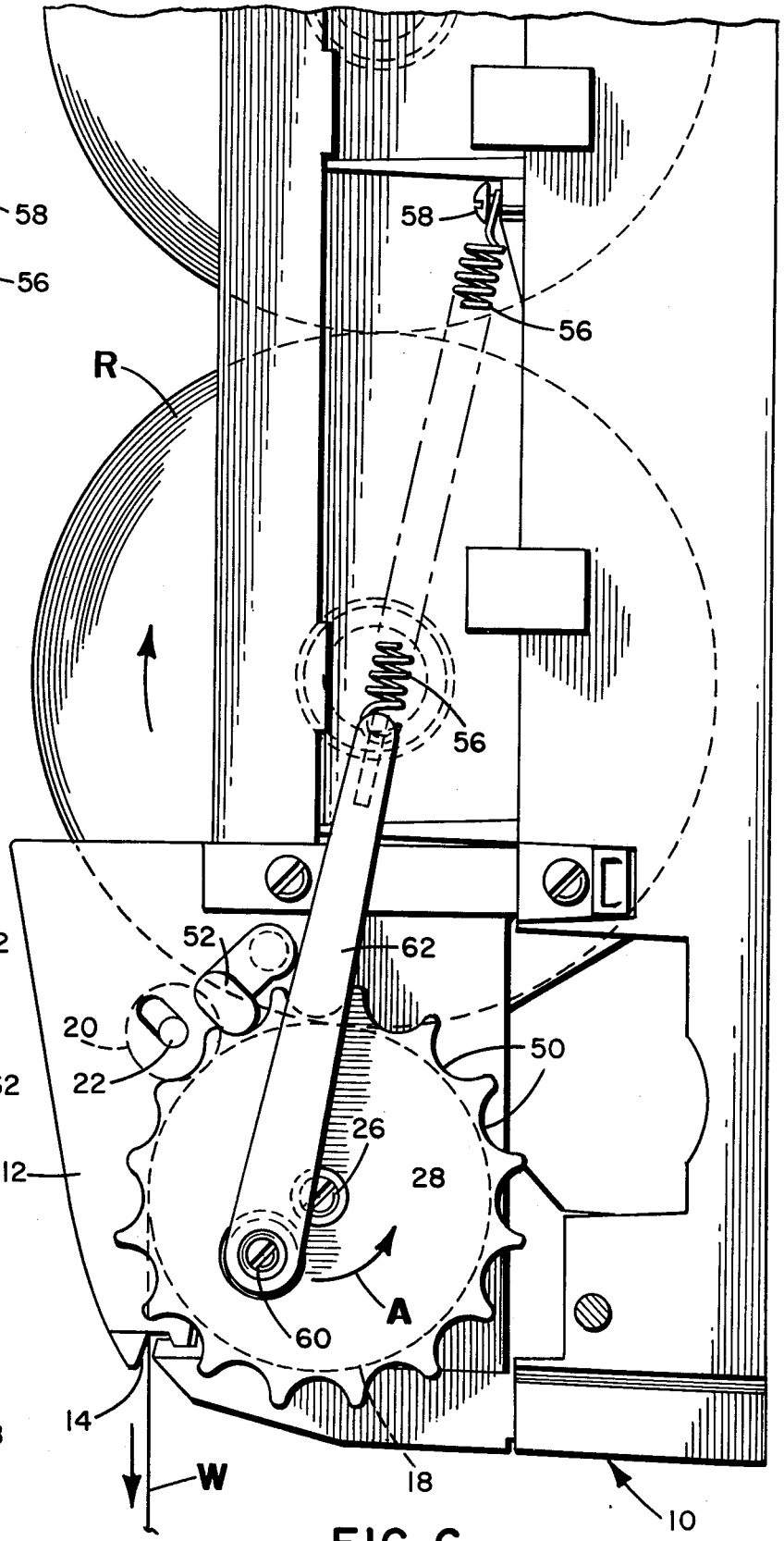
FIG. 6 is an elevational view showing the over-center means and anti-reversing pawl engaging notches spaced around the periphery of the feed wheel.

Referring to FIGS. 5 and 6, the feed wheel 28 is shown mounted on the outer end of stub shaft 26. The feed wheel is provided with notches 50 spaced around its perimeter and anti-reversing pawl 52 is mounted on the chassis 12 to be freely pivotal into engagement with notches 50 to prevent reverse rotation of the feed wheel 28 and likewise feed roller 18.

The feed roller 18 is driven through a portion of each rotation by an over-center means including a spring 56 connected to the chassis 12 by fastener 58 and to the feed wheel 28 by screw 60, such screw 60 being off-center from the rotation axis of feed wheel 28 and feed roller 18. It will be readily understood that during rotation of feed wheel 28 and feed roller 18 in the direction of arrow A on FIG. 6 the spring 56 is initially tensioned as it approaches the position of link 62 shown on FIG. 6. When the screw 60 passes beyond alignment of link 62 with stub shaft 26 the over-center means is energized to its maximum. Therefore the spring uses its stored energy to assist further rotation of the feed wheel 28 and feed roller 18 to activate the knife so that the web is severed and additional flexible sheet material is fed into position for the next use of the dispenser.

The foregoing set forth a detailed description of the dispenser and cutting mechanism of the invention, the latter being adapted to be used in the former, although not being restricted to use solely therein. Moreover, it is recognized that various modifications of both the dispenser and cutting mechanism of the invention may occur to those skilled in the art. Therefore the scope of the invention is to be limited solely by the scope of the appended claims.

I claim:

1. In a dispenser for rolls of flexible sheet material having, a chassis adapted to be attached to a wall, means carried by said chassis for rotatably supporting a roll of flexible sheet material, means operatively connected to said chassis for guiding a web of flexible sheet material from the roll to a position to be grasped by a user so that the user may pull the web out of the dispenser, mechanism mounted on said chassis for cutting the web at intervals therealong to divide the web into individual sheets, the improvement wherein said cutting mechanism includes:

a rotatably mounted feed roller on the chassis and over which the web of material passes, a knife pivotally mounted in the feed roller to swing about an axis which is laterally displaced from the plane of the knife cutting edge, said knife having a radially outward portion defining said cutting edge for the web, said edge being projected outwardly through an opening in said feed roller beyond the periphery of the feed roller to cut the web as it passes over the feed roller, cam follower means affixed to the knife at a point displaced from the pivot mounting axis of the knife so that said cam follower means is swingable along an arcuate path about said axis, and cam means stationarily mounted on the chassis and having a first cam surface engaged with said cam follower means to swing said cam follower means along said arcuate path to positively project the knife cutting edge upon rotation of the feed roller and having a second cam surface engaging said cam follower to swing said cam follower means along said arcuate path to positively retract the knife cutting edge upon further rotation of said roller.

2. A dispenser as recited in claim 1 wherein a pinch roller cooperatively engages with said feed roller and the web passes between said rollers, said stationary cam means having a configuration to project the knife cutting edge beyond the feed roller periphery immediately after the web passes beyond the bite of the rollers.

3. A dispenser as recited in claim 1 wherein the cam follower means comprises a cam roll mounted at each end of the cutting knife to project beyond the ends of said feed roller and said cam means comprises a plate cam fixed to said chassis adjacent each end of said feed roller.

4. A dispenser as recited in claim 3 wherein each cam has an inside cam track facing outwardly to define said first cam surface and an outside cam track facing inwardly to define said second cam surface with the two tracks being spaced apart throughout their lengths to accommodate one of said cam rolls therebetween so that said inside cam track drives the cam roll to positively project said knife and said outside cam track drives the cam roll to positively retract said knife upon feed roller rotation.

5. A dispenser as recited in claim 1 wherein said cam means comprises an inside cam track facing outwardly to define said first cam surface and an outside cam track facing inwardly to define said second cam surface with the two tracks being spaced apart throughout their lengths to accommodate said cam follower means therebetween so that said inside cam track drives said knife to project the knife cutting edge and said outside cam track drives said knife to retract said cutting edge.

6. A dispenser as recited in claim 1 wherein said knife is mounted on pins pivotally cooperating with openings in the opposite ends of said feed roller with the knife cutting edge disposed parallel to the axis of said pins.

7. A dispenser as recited in claim 6 wherein said cam follower means comprises a cam roll adjacent each end of said knife cutting edge and said cam means includes a stationary plate cam mounted on said chassis adjacent each end of said feed roller, each cam being engaged by one cam roll.

8. A dispenser as recited in claim 7 wherein each said cam has two spaced cam tracks, one facing outwardly to define said first cam surface and the other facing inwardly to define said second cam surface, with one said cam roll being confined between said two tracks whereby the tracks conjointly drive the said cam rolls to control the projecting and retracting movements of said knife.

9. A dispenser as recited in claim 1 wherein a pinch roller is biased into rotating contact with said feed roller, for the web to pass between said rollers, said feed roller is driven through a portion of each rotation by an over-center means including a spring connected between said chassis and a feed wheel associated with said feed roller, said spring being connected off center from the rotational axis of said feed roller, and an anti-reversing pawl engages in notches spaced around the perimeter of said feed wheel to prevent reverse rotation of said feed roller.

10. A dispenser as recited in claim 1 wherein said cam follower means comprises a cam roll mounted at each end of said knife to project beyond the ends of said feed roller, said feed roller having end caps which are arcuateley slotted to accomodate the mountings for the cam rolls and their movement incident projecting and retracting of said cutting edge, said cam means comprises a plate cam fixed to said chassis adjacent each end of said feed roller, each plate cam having a pocket of substantially uniform width throughout its length to receive one said cam roll with said pocket opening toward the end of said feed roller, said pocket having a parti-cylindrical portion with its center of curvature corresponding with the axis of said feed roller, and an outwardly curved portion extending away from said feed roller axis which latter portion is joined at its ends with the ends of said parti-icylindrical portion to form said pocket into an endless cam configuration to drive the cam roll upon rotation of said feed roller.

* * * * *